US007216458B2

(12) United States Patent
Taouil

(10) Patent No.: US 7,216,458 B2
(45) Date of Patent: May 15, 2007

(54) CONTOURED GUTTER END CAP

(76) Inventor: Frederick A. Taouil, 345 W. 58th St., New York, NY (US) 10019

( * ) Notice: Subject to any disclaimer, the term of this patent is extended or adjusted under 35 U.S.C. 154(b) by 560 days.

(21) Appl. No.: 10/767,741

(22) Filed: Jan. 30, 2004

(65) Prior Publication Data

US 2005/0166467 A1 Aug. 4, 2005

(51) Int. Cl.
*E04D 13/06* (2006.01)

(52) U.S. Cl. ..... 52/11; 52/15

(58) Field of Classification Search ..... 52/11, 52/12, 13, 15, 16; 248/48.1; 210/474
See application file for complete search history.

(56) References Cited

U.S. PATENT DOCUMENTS 190,382 A * 5/1877 Snyder ..... 52/16
1,460,733 A 7/1923 Rigby
2,461,610 A * 2/1949 Lord ..... 52/12
4,142,370 A 3/1979 Giordano
4,407,097 A 10/1983 Allen
D297,561 S 9/1988 Leisemann
5,245,800 A 9/1993 Davenport
5,253,456 A * 10/1993 Todd ..... 52/11

* cited by examiner

*Primary Examiner*—Jeanette E. Chapman
*Assistant Examiner*—Chi Q. Nguyen
(74) *Attorney, Agent, or Firm*—Richard C. Litman

(57) ABSTRACT

The contoured gutter end cap has front and end walls with contours that correspond to the contours on the front wall of a length of standard gutter and thereby forms a more attractive gutter end when attached to the end of the gutter. It is formed with a bottom and three adjoining walls—a front wall, end wall and back wall. The back wall is substantially flat to allow for positioning against a vertical surface of a house or other structure.

7 Claims, 6 Drawing Sheets

CONTOURED GUTTER END CAP

BACKGROUND OF THE INVENTION

1. Field of the Invention

The present invention relates to rain gutters, and more particularly, to a rain gutter end cap with front and end walls contoured to correspond to the contours of an attached gutter.

2. Description of the Related Art

Rain gutters are commonly used to carry rainwater from the roof of a house or other structure to a desired location on the ground. Typically, they are continuous lengths of metal formed with an open top, a front wall, a bottom and a back wall. The back wall is normally positioned flush against a vertical surface on the house or other structure such that the open top is positioned under the bottom edge of the roof. For aesthetic purposes, the front wall is usually formed with at least one decorative ridge or crease extending the length of the gutter.

End caps are used to close off the ends of a gutter where the gutter does not extend completely around the periphery of a house. These end caps consist of a flat vertical wall with edges that mate with the bottom and walls of the gutter. Unfortunately, these end caps suffer one well-known drawback. Because the flat vertical surface of an end cap contrasts sharply with the contoured surface of a front wall, the end caps are conspicuously unsightly.

Examples of gutter end caps that are comprised of a flat vertical wall are provided by U.S. Design Pat. No. 297,561 issued on Sep. 6, 1988 to P. P. Leisemann; U.S. Pat. No. 1,460,733 issued on May 25, 1922 to T. Rigby; U.S. Pat. No. 4,142,370 issued Mar. 6, 1979 to L. G. Giordano; and U.S. Pat. No. 4,407,097 issued on Oct. 4, 1983 to J. H. Allen.

U.S. Pat. No. 5,245,800 issued Sep. 21, 1993 to R. G. Davenport teaches a gutter end cap having a curved outside end wall and interior sloped flat walls to help the flow of water into the gutter. However, the interior walls of this end cap present at least four known drawbacks. First, the interior walls add time and expense to the manufacture of the end cap. Second, the interior walls increase the time and complexity of installation of the end cap. Third, the interior walls prevent the end caps from being easily stacked, stored and transported. And fourth, the interstice between the interior and outer walls provide an ideal nesting location for bees and other insects.

Consequently, none of the above inventions and patents, taken either singly or in combination, is seen to describe the instant invention as claimed. Thus a gutter end cap solving the aforementioned problem is desired.

SUMMARY OF THE INVENTION

The contoured gutter end cap has front and end walls with contours that correspond to the contours on the front wall of a length of standard gutter and thereby forms a more attractive gutter end when attached to the end of the gutter. It is formed with a bottom and three adjoining walls—a front wall, end wall and back wall. The back wall is substantially flat to allow for positioning against a vertical surface on a house or other structure.

The device also allows a gutter to be extended slightly beyond the corner of a structure on which the roofline extends slightly beyond the end of the fascia board. Thus, in such circumstances, the gutter would catch all of the rainwater running off the roof.

Additionally, with its end wall sloped inward into the gutter, the gutter end cap assists the flow of water into and through the gutter.

Accordingly, it is a principal object of the invention to provide a gutter end cap with contoured front and end walls that correspond to the contours on the front wall of a gutter and thereby provide a desirable looking gutter end.

It is another object of the invention to provide a gutter end cap that allows a gutter to be extended slightly beyond the corner of a structure on which the roofline extends slightly beyond the end of the fascia board.

It is a further object of the invention to provide a gutter end cap with its end wall sloped inward into the gutter to thereby assist the flow of water into and through the gutter.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 2:
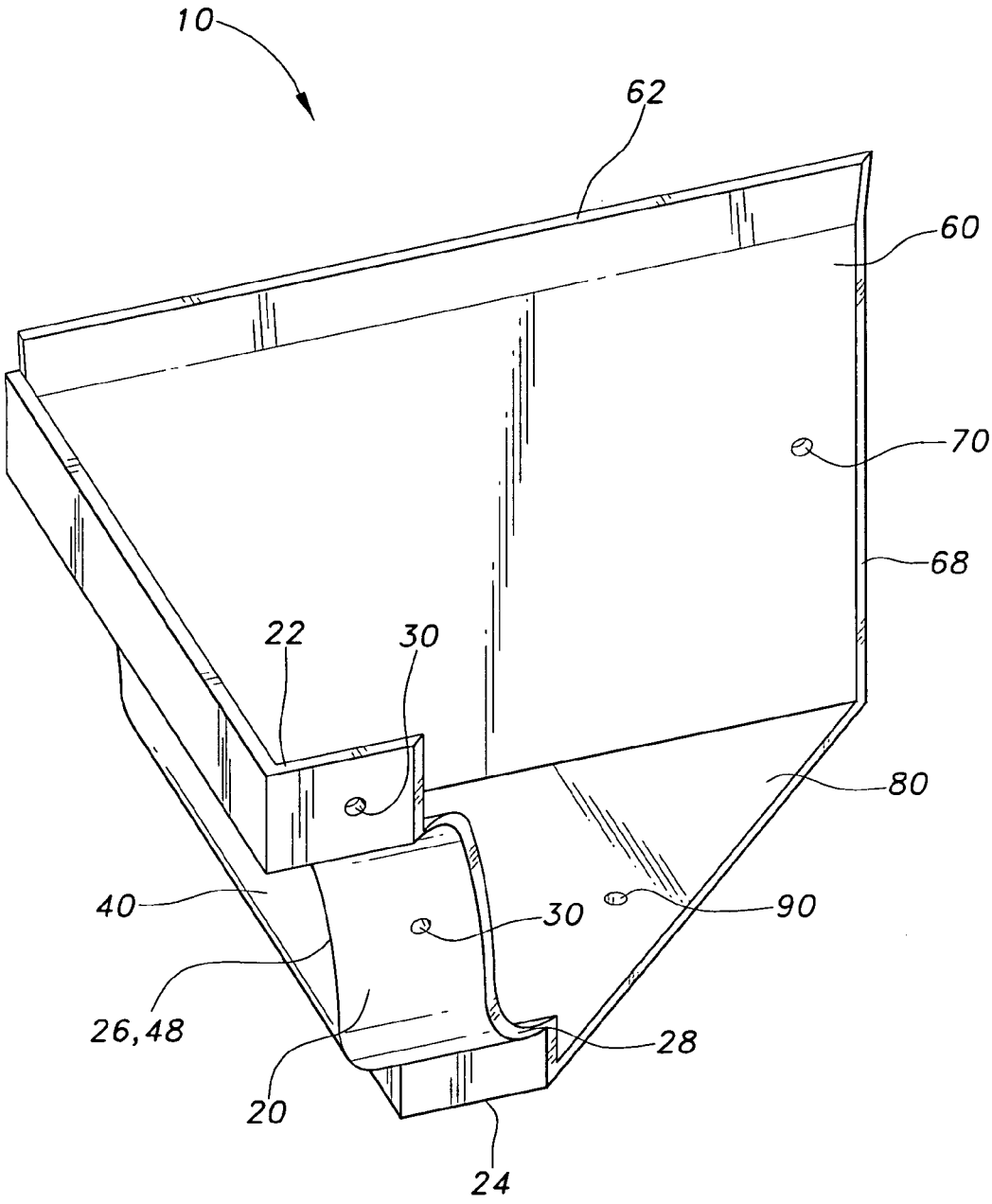
FIG. 2 is a perspective view of a contoured gutter end cap according to the present invention.
Figure 3:
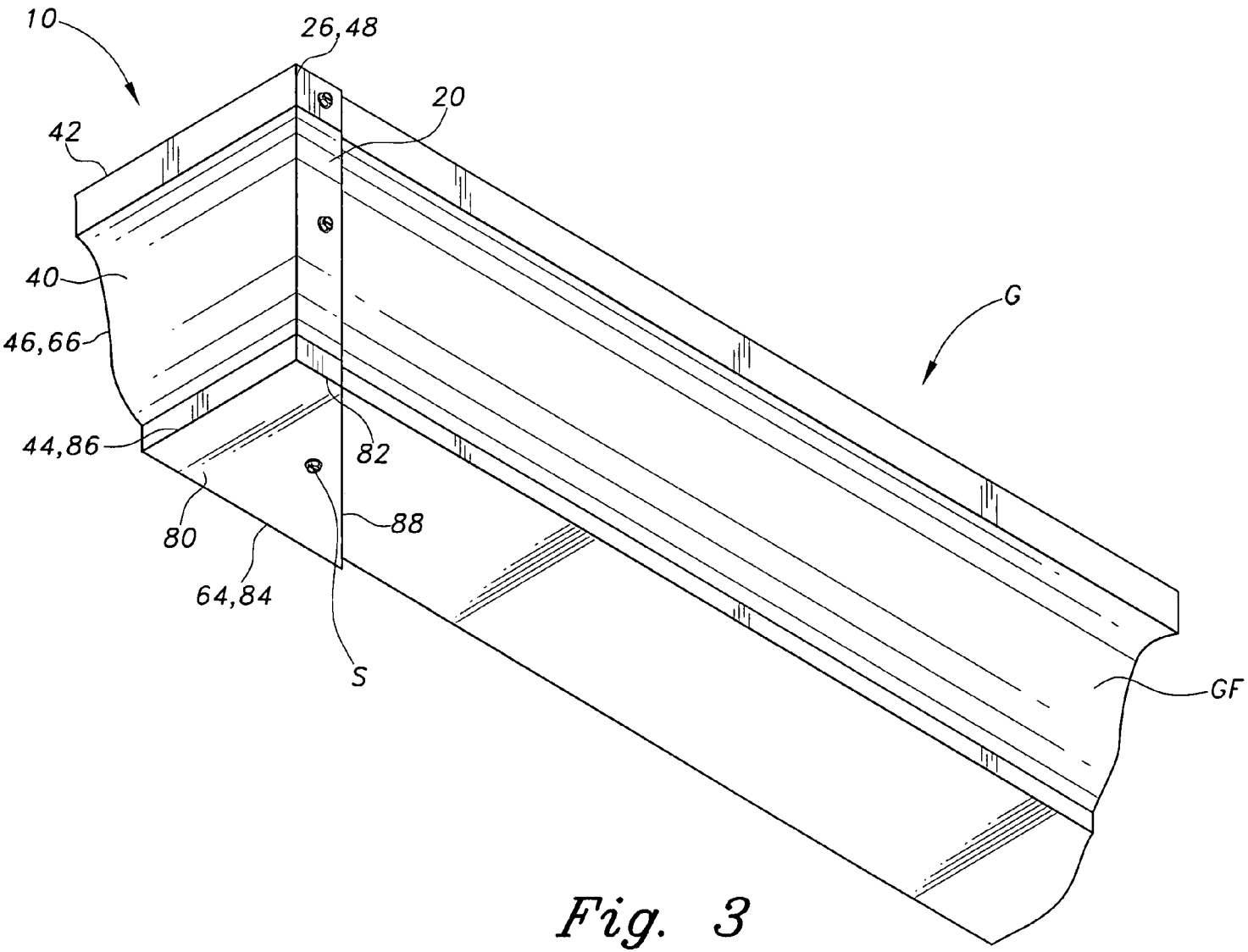
FIG. 3 is a perspective view of a contoured gutter end cap according to the present invention as attached to a gutter.
Figure 4:
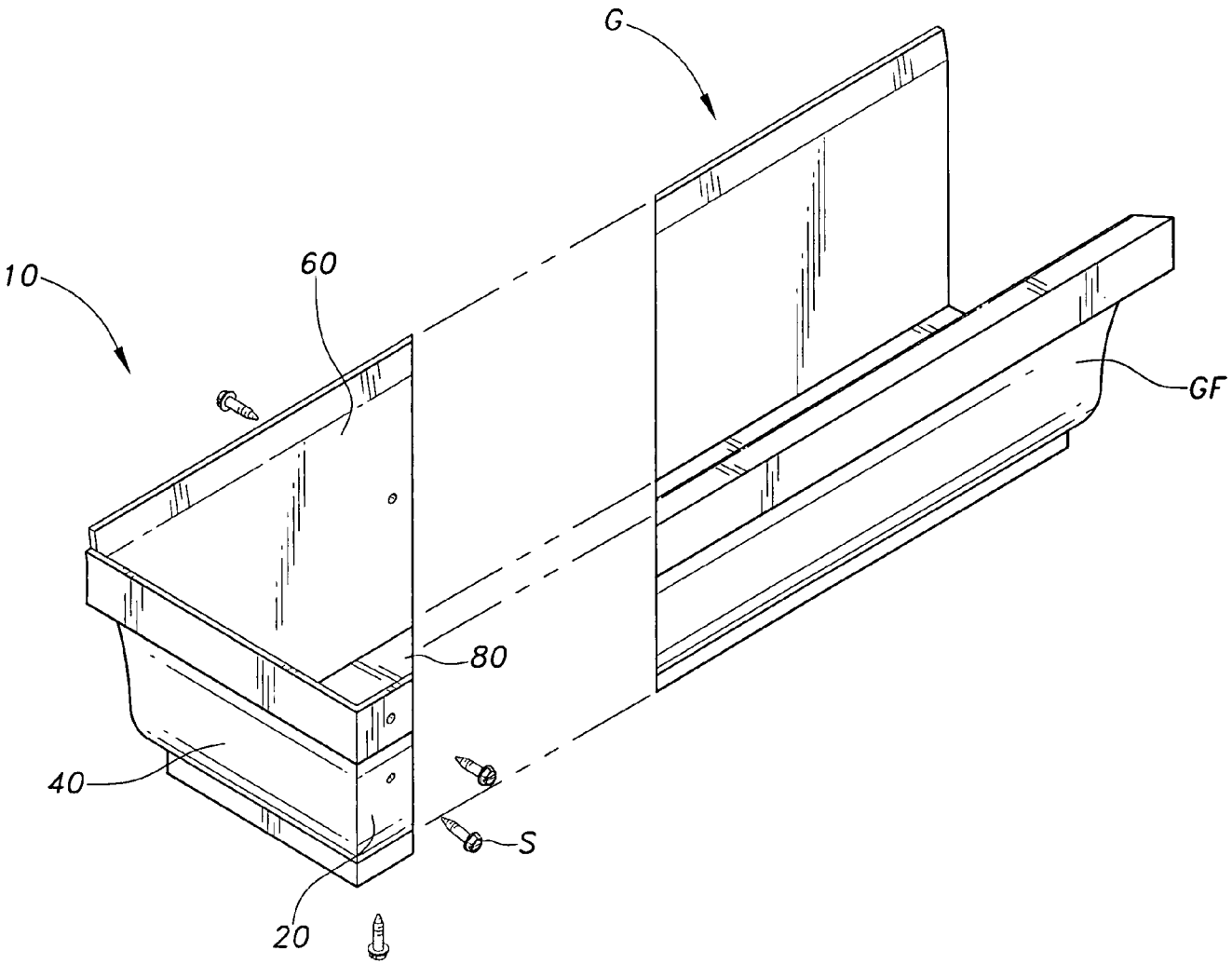
FIG. 4 is an exploded view of FIG. 3.
Figure 5:
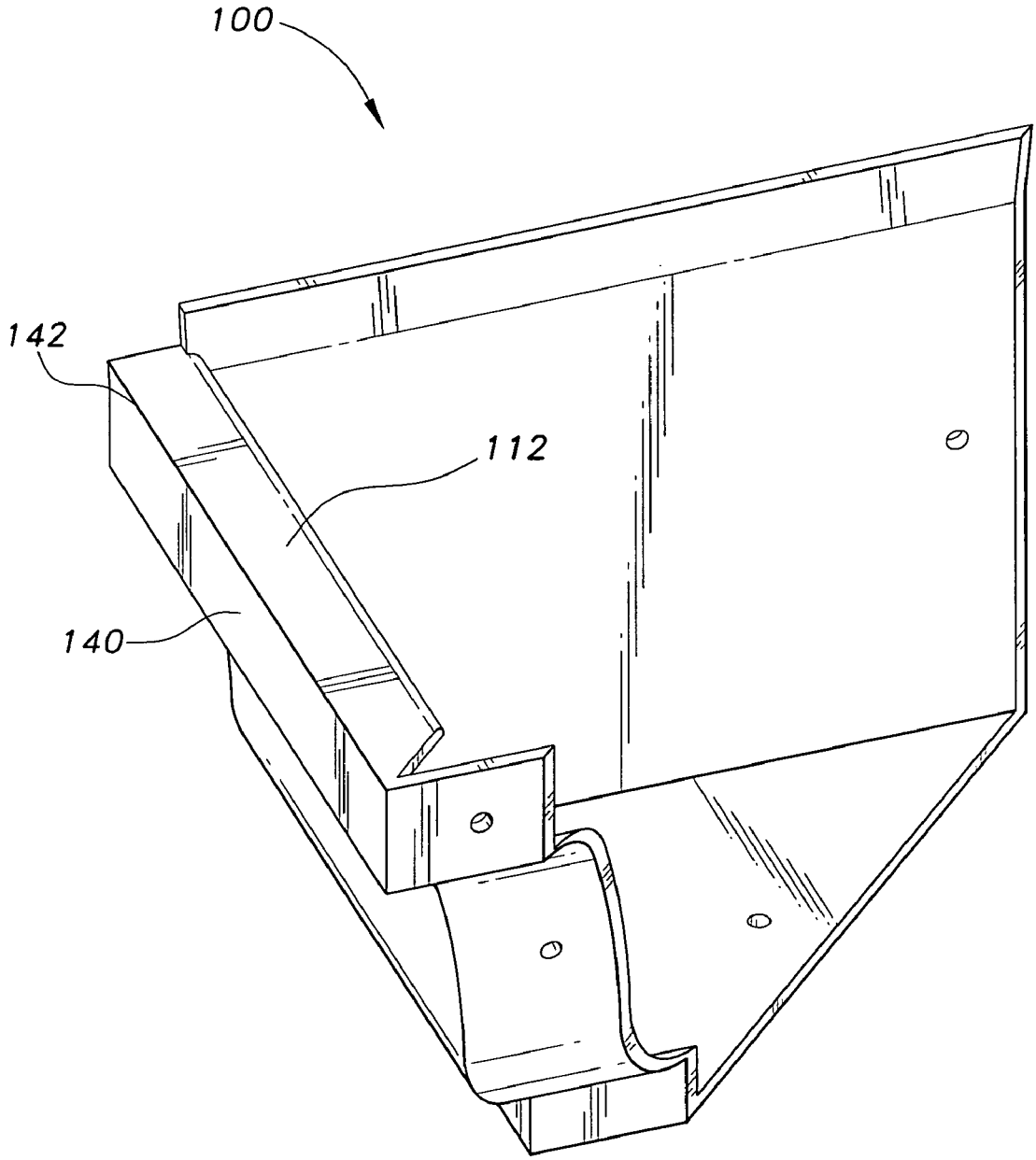
FIG. 5 is a perspective view of an alternative embodiment of a contoured gutter end cap according to the present invention.
Figure 6:
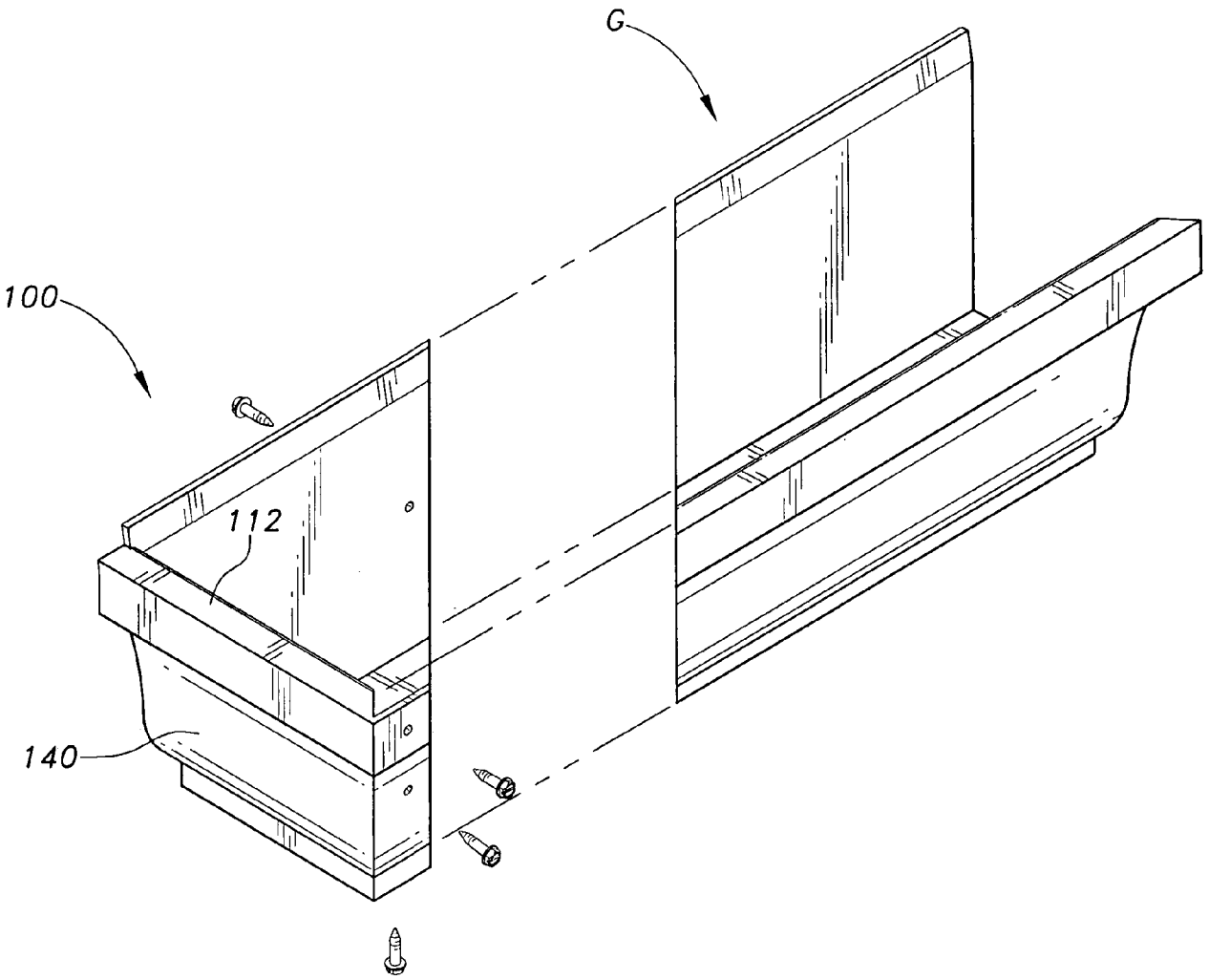
FIG. 6 is an exploded view of the alternative embodiment of FIG. 5 shown in relation to a gutter.

The present invention is a contoured gutter end cap designated generally as 10 in the drawings. Referring to FIGS. 2, 3 and 4, the invention 10 includes a front wall 20, an end wall 40, a back wall 60, and a bottom 80.

The front wall 20 has a top edge 22, a bottom edge 24, and two side edges 26 and 28. Wall 20 is contoured to correspond to the contours of the front wall GF of a standard length of contoured gutter G. From bottom edge 24, wall 20 extends upward substantially vertically and then arcs outward and upward first forming a convex arc, then a concave arc relative to wall 20 outer surface. Wall 20 then extends substantially vertically again to wall 20 top edge 22. Wall 20 has two holes 30 through which setscrews S are used to secure wall 20 to a length of gutter G.

The end wall 40 has a top edge 42, a bottom edge 44, a proximal edge 46 and a distal edge 48. It 40 is also contoured to correspond to the contours of the front wall GF of a standard length of contoured gutter G, and from its 40 bottom edge 44, extends upward substantially vertically and then arcs outward and upward first forming a convex arc then a concaved arc relative to its 40 outer surface. It 40 then extends substantially vertically again to its 40 top edge 42.

The back wall 60 has a top edge 62, a bottom edge 64, and two side edges 66 and 68, and is substantially flat and substantially vertical. It 60 has a hole 70 through which a setscrew S is used to secure it 60 to a length of gutter G.

The bottom 80 has a front edge 82, a back edge 84, and two side edges 86 and 88, and is substantially flat and substantially horizontal. Its 80 front edge 82 adjoins the bottom edge 24 of the front wall 20. Its back edge 84 adjoins the bottom edge 64 of the back wall 60, and one 86 of its side edges adjoins the bottom edge 44 of the end wall 40. It 80 has a hole 90 through which a setscrew S is used to secure it 80 to a length of gutter G.

One of the side edges 26 of the front wall 20 adjoined the distal edge 48 of the end wall 40, and the proximal edge 46 of the end wall adjoins one of the side edges 66 of the back wall 60. As can be seen in FIGS. 2–6, the second edge 88 of the bottom 80 adjoins the second edge 28 of the front wall 20 and the second side edge 68 of the back wall 60 at an acute angle.

The contoured gutter end cap 10 is attached to a length of gutter G by positioning its bottom, and front and back walls over the outer surface of corresponding walls on a length of gutter G, inserting a set screw S through the holes 30, 70 and 90, and into the gutter walls, and applying a calking sealant to the seams formed by the overlap of the end cap walls 20, 60 and 80 with the length of gutter G and to holes 30, 70 and 90 and setscrews S.

In an alternative embodiment 100, a top wall 112 extends horizontally from the top edge 142 of the end wall 140 to mate with lengths of gutter G having corresponding top walls. See FIGS. 5 and 6.

Figure 1:
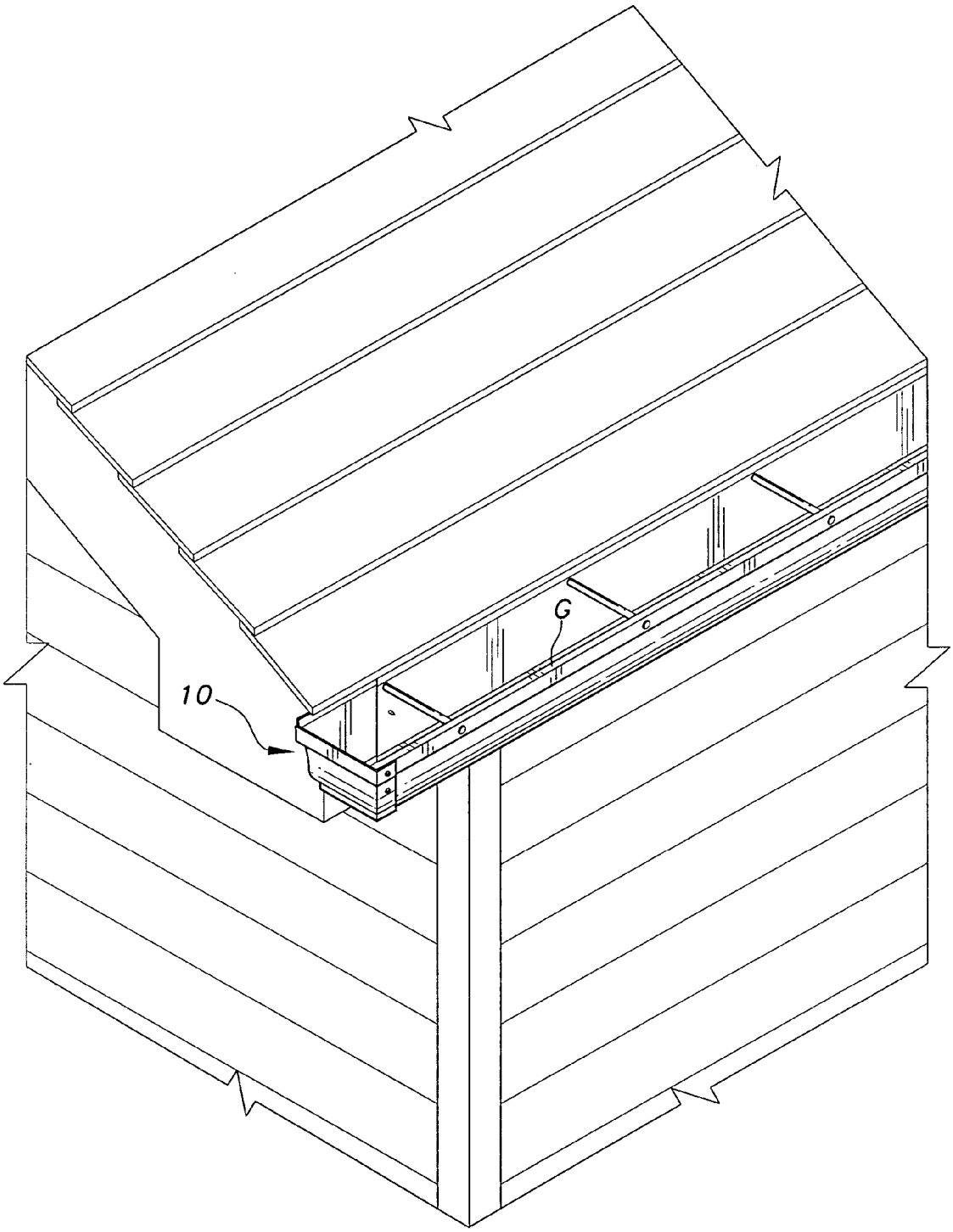
FIG. 1 is an environmental, perspective view of a contoured gutter end cap according to the present invention shown attached to a gutter that is mounted along the roofline of a house.

FIG. 1 shows the invention 10 attached to a length of gutter that is mounted along the roofline of a house.

The invention 10 is constructed from sheet metal, such as aluminum or copper, or from plastic, and is formed by cutting, pressing, wielding or molding.

It is to be understood that the present invention is not limited to the embodiments described above, but encompasses any and all embodiments within the scope of the following claims.

I claim:

1. A contoured gutter end cap, comprising:

a front wall having a top edge, a bottom edge, and a first and second side edge, said front wall being contoured to correspond to the contours of an attached gutter;

an end wall having a top edge, a bottom edge, a distal edge and a proximal edge, said end wall being contoured to correspond to the contours of an attached gutter;

a back wall having a top edge, a bottom edge, and a first and second side edge, said back wall being substantially vertical and substantially flat; and a bottom having a front edge, a back edge, and a first and second side edge, said bottom being substantially horizontal and substantially flat;

wherein said first side edge of said front wall adjoins said distal edge of said end wall and said bottom edge of said front wall adjoins said front edge of said bottom;

wherein said proximal edge of said end wall adjoins said first side edge of said back wall and said bottom edge of said end wall adjoins said first side edge of said bottom;

wherein said second side edge of said bottom adjoins said second side edge of said front wall and said second side edge of said back wall at an acute angle; and wherein said back edge of said bottom adjoins said bottom edge of said back wall.

2. The contoured gutter end cap according to claim 1, further comprising a top wall extending substantially horizontally from said top edge of said end wall.

3. The contoured gutter end cap according to claim 1, wherein said contoured gutter end cap is fabricated from metal.

4. The contoured gutter end cap according to claim 1, wherein said contoured gutter end cap is fabricated from plastic.

5. The contoured gutter end cap according to claim 1, further having apertures dimensioned and configured for setscrews.

6. A contoured gutter end cap, consisting of:

a front wall having a top edge, a first side edge, a second side edge and a bottom edge, said front wall being contoured to correspond to the contours of an attached gutter;

an end wall having a top edge, a distal edge, a proximal edge and a bottom edge, said end wall being contoured to correspond to the contours of an attached gutter;

a back wall having a top edge, a first side edge, a second side edge and a bottom edge, said back wall being substantially vertical and substantially flat; and a bottom having a front edge, a first and second side edge and a back edge, said bottom being substantially horizontal and substantially flat;

wherein said first side edge of said front wall adjoins said distal side edge of said end wall and said bottom edge of said front wall adjoins said front edge of said bottom;

wherein said proximal side edge of said end wall adjoins said first side edge of said back wall and said bottom edge of said end wall adjoins said first side edge of said bottom;

wherein said second side edge of said bottom adjoins said second side edge of said front wall and said second side edge of said back wall at an acute angle; and wherein said back edge of said bottom adjoins said bottom edge of said back wall.

7. A contoured gutter end cap, comprising:

a front wall being contoured to correspond to the contours of an attached gutter;

an end wall being contoured to correspond to the contours of an attached gutter;

a back wall being substantially vertical and substantially flat; and a bottom being substantially horizontal and substantially flat, said bottom further being acutely angled from the front wall to the back wall;

wherein said front wall adjoins said end wall and said bottom;

wherein said end wall adjoins said back wall and said bottom; and wherein said bottom adjoins said back wall.

* * * * *